US007806296B2

(12) United States Patent
Connors

(10) Patent No.: US 7,806,296 B2
(45) Date of Patent: Oct. 5, 2010

(54) VARIABLE DESIGN BATHROOM ACCESSORY

(75) Inventor: James Connors, Cincinnati, OH (US)

(73) Assignee: Saturday Knight Ltd., Cincinnati, OH (US)

( * ) Notice: Subject to any disclaimer, the term of this patent is extended or adjusted under 35 U.S.C. 154(b) by 272 days.

(21) Appl. No.: 12/169,221

(22) Filed: Jul. 8, 2008

(65) Prior Publication Data

US 2009/0014347 A1 Jan. 15, 2009

Related U.S. Application Data

(60) Provisional application No. 60/948,842, filed on Jul. 10, 2007.

(51) Int. Cl.
*B05B 11/00* (2006.01)
*B65D 73/00* (2006.01)

(52) U.S. Cl. ..... 222/78; 206/457; 206/459.5; 222/192

(58) Field of Classification Search ..... 206/457, 206/459.5, 581, 223; 40/310–312; 215/390; 220/4.01, 737; 222/78, 173, 192, 231, 394
See application file for complete search history.

(56) References Cited

U.S. PATENT DOCUMENTS

| | | | | |
|---|---|---|---|---|
| 2,931,657 | A * | 4/1960 | Lewis | 273/155 |
| 4,445,691 | A * | 5/1984 | Stark et al. | 273/155 |
| 5,400,907 | A * | 3/1995 | Chen | 206/459.1 |
| 6,119,850 | A * | 9/2000 | Chen et al. | 206/457 |
| 6,155,411 | A * | 12/2000 | Ho | 206/457 |
| 6,193,146 | B1 * | 2/2001 | Morrow et al. | 206/459.5 |
| 6,398,065 | B1 * | 6/2002 | Lewis | 220/737 |
| 6,564,962 | B1 * | 5/2003 | Cheng | 206/457 |

* cited by examiner

*Primary Examiner*—Luan K Bui
(74) *Attorney, Agent, or Firm*—Wood, Herron & Evans, L.L.P.

(57) ABSTRACT

A variable design bathroom accessory having a holder, a central axis, a fixed tier attached to the holder, and a rotatable tier rotatable about the holder and in proximity to the fixed tier. The fixed tier has a fixed side with a design thereon. The rotatable tier has a rotatable side with another design thereon. The rotatable tier is rotatable around the central axis to align with the fixed visible side such that the fixed tier design and rotatable tier design form a composite design.

19 Claims, 4 Drawing Sheets

VARIABLE DESIGN BATHROOM ACCESSORY

CROSS REFERENCE TO RELATED APPLICATIONS

This application claims the benefit of U.S. Provisional Application No. 60/948,842, filed Jul. 10, 2007, which is hereby incorporated by reference herein in its entirety.

FIELD OF THE INVENTION

This invention relates to bathroom accessories and more particularly to bathroom accessories having a fixed tier and a rotatable tier, each tier having a design on a visible side such that when the sides are aligned the designs create at least one composite design.

BACKGROUND OF THE INVENTION

Like many other rooms in a home, a bathroom may contain functional items. Quite often, in addition to their operation, items also present aesthetic or appearance considerations. To enhance their aesthetic features, bathroom accessories are sold as ensembles with matching soap dishes, tumblers, toothbrush holders, and other matching components. However, appearance does not influence certain types or groups of people as much as others.

In particular, children are engaged by other elements of design beyond the appearance of an ensemble. While it is universally recognized that children could spend more time washing their hands or brushing their teeth when they are in the bathroom, getting them to do so is challenging. Thus, merely introducing a matching ensemble into a bathroom is not likely to markedly improve a child's personal hygiene.

Unlike children, adults tend to appreciate personal hygiene to a greater degree. While adults may be pleased with the aesthetic appearance of bathroom accessories, they may be entertained, much like children, by bathroom accessories that are not only aesthetically pleasing, but have novel and entertaining characteristics.

What is needed are bathroom accessories that provide entertainment and motivate children of all ages while fulfilling more ordinary, operational functions and desired aesthetics.

These and other objectives and advantages of the invention will be readily appreciated from the foregoing, and from the following written description and drawings, in which:

SUMMARY OF THE INVENTION

According to one embodiment of the present invention, a variable design bathroom accessory comprises a holder, a fixed tier, and a first rotatable tier. The holder has a central axis. The fixed tier is attached to the holder and has a fixed side with a first design thereon. The first rotatable tier is rotatable about the holder and is in proximity to the fixed tier. The first rotatable tier has a first rotatable side with a second design thereon. The first rotatable tier is rotatable around the central axis, whereby rotation of the first rotatable tier aligns the fixed side with the first rotatable side such that the first design and the second design form a composite design.

In another embodiment, a liquid dispenser includes a pump for dispensing a liquid and a liquid reservoir for storing the liquid. The liquid reservoir has a central axis. The liquid dispenser comprises the fixed tier and the rotatable tier. The fixed tier is attached to the liquid reservoir. The fixed tier has a fixed side with a first design thereon. The first rotatable tier is rotatable about the liquid reservoir and is in proximity to the fixed tier. The first rotatable tier has a first rotatable side with a second design thereon. The first rotatable tier is rotatable around the central axis, whereby rotation of the first rotatable tier aligns the fixed side and the first rotatable side such that the first design and the second design form a composite design.

In another embodiment, the liquid dispenser comprises the fixed tier, the first rotatable tier, and a second rotatable tier. The fixed tier is attached to the liquid reservoir, has a square perimeter, and four fixed sides each with a design thereon. The first rotatable tier is rotatable about the liquid reservoir and is in proximity to the fixed tier. The first rotatable tier has a square perimeter, four first rotatable sides each with a design thereon, and is rotatable around the central axis. The second rotatable tier is rotatable about the liquid reservoir and is in proximity to the first rotatable tier. The second rotatable tier has the square perimeter, four second rotatable sides each with a design thereon, and is rotatable around the central axis, whereby rotation of the first rotatable tier aligns one fixed side with one first rotatable side, and rotation of the second rotatable tier aligns one second rotatable side with the one first rotatable side such that one design on the fixed tier, one design on the first rotatable tier, and one design on the second rotatable tier form one composite design.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
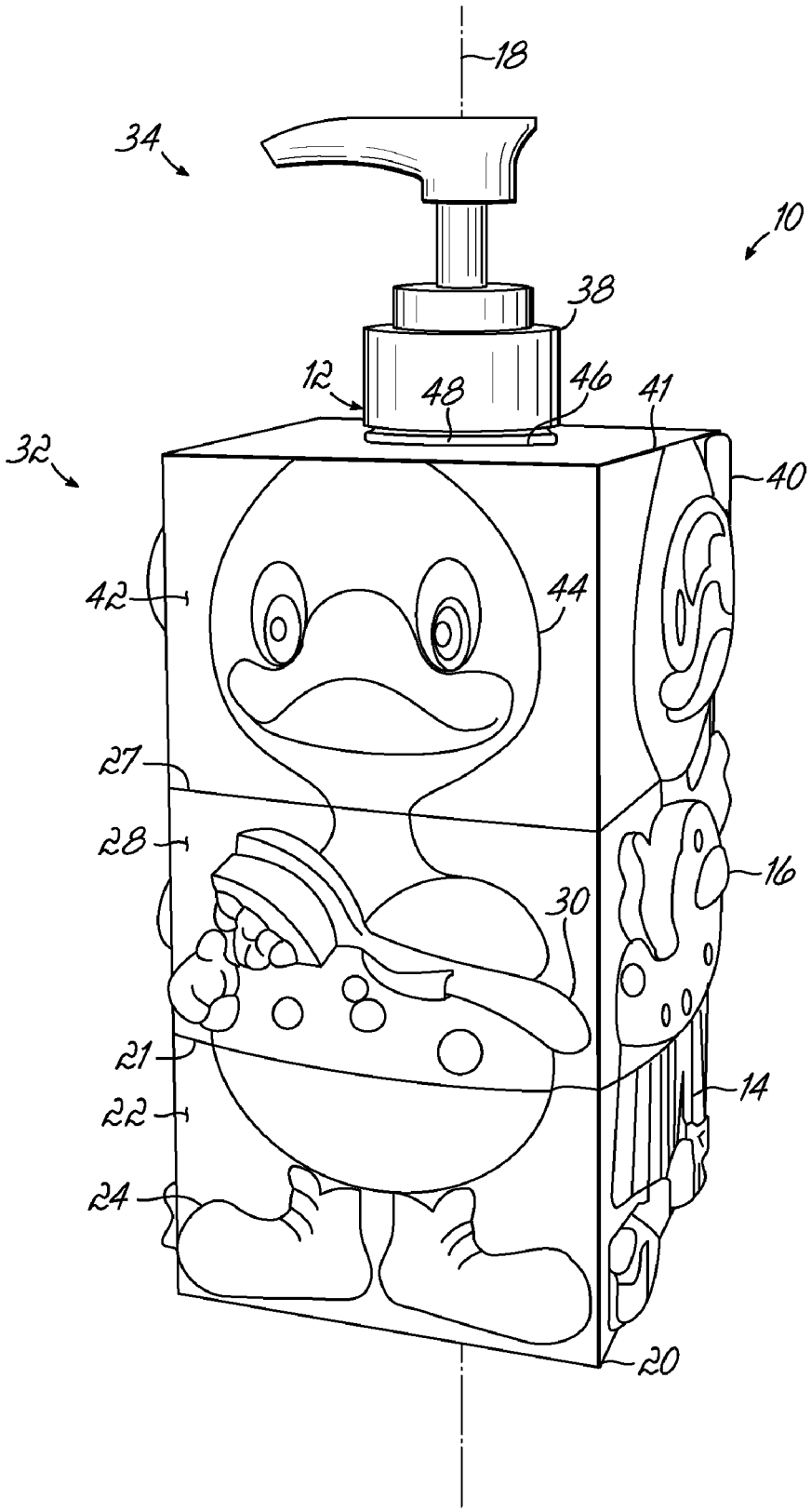
FIG. 1 is a perspective view of one embodiment of a variable design bathroom accessory.

Turning to the drawings and particularly FIGS. 1-4, it will be appreciated that the variable design bathroom accessory 10, in one embodiment, comprises a holder 12, a fixed tier 14, and at least one rotatable tier 16. Furthermore, the holder 12 has a central axis 18. As will be described in more detail below, the fixed tier 14 is associated with the holder 12. For example, the fixed tier 14 may be attached to the holder 12 such that the fixed tier 14 remains stationary. In one embodiment, the fixed tier 14 forms a base 20 for the variable design bathroom accessory 10. In the exemplary embodiment shown in FIG. 1, the holder 12 is a liquid dispenser, described in more detail below.

With continued reference to FIG. 1, in one embodiment, the fixed tier 14 is positioned around a base (not shown) of the holder 12 and is fixed thereto. The fixed tier 14 has a geometric shape with a polygon-shaped perimeter 21 and has at least one fixed side 22 that is visible to a person using the variable design bathroom accessory 10. The fixed side 22 has at least one design 24 formed thereon. In the exemplary embodiment, the design 24 on the fixed side 22 is a pair of feet.

Figure 2:
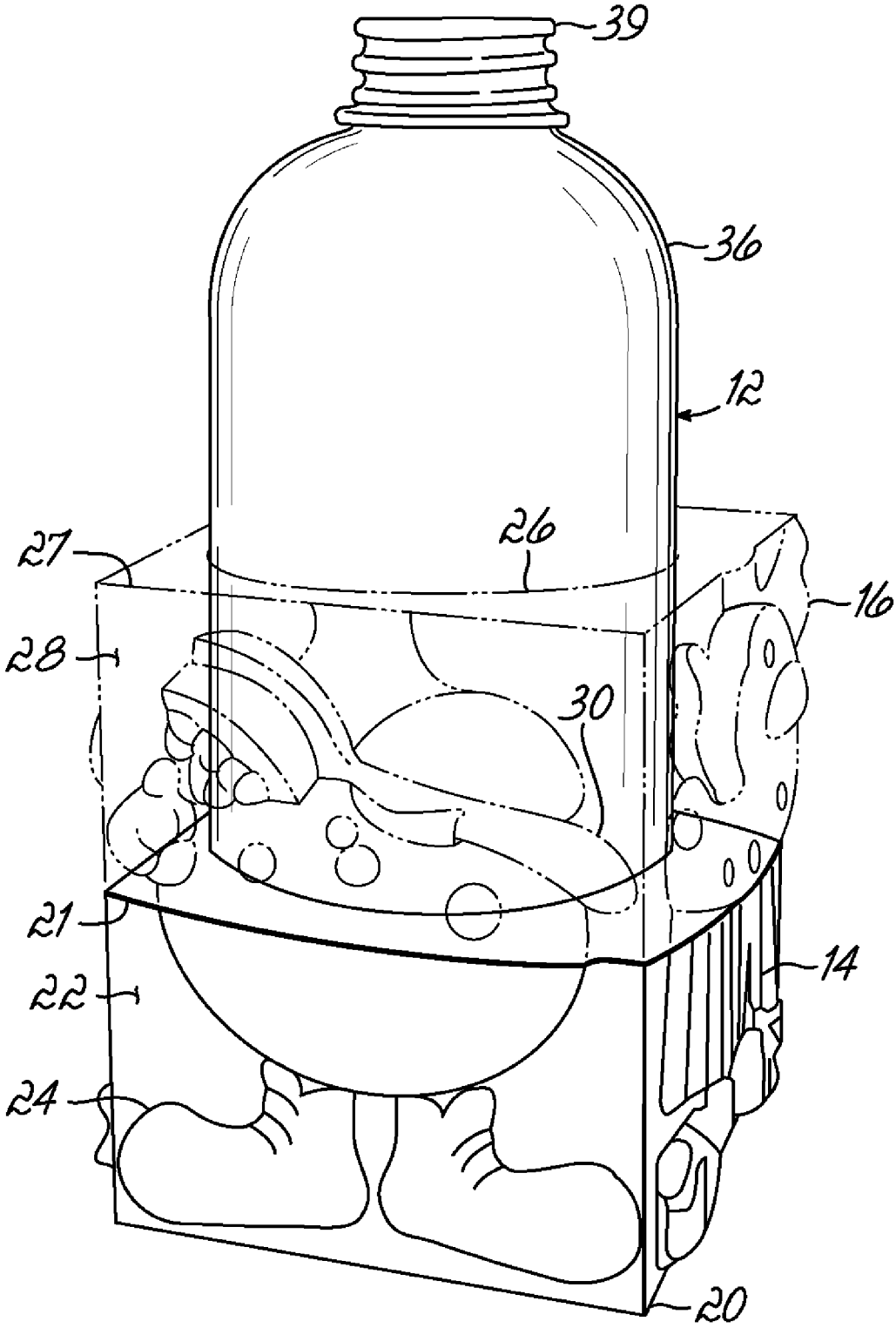
FIG. 2 is a perspective view of the variable design bathroom accessory showing a fixed tier with a rotatable tier drawn in phantom line.
Figure 3:
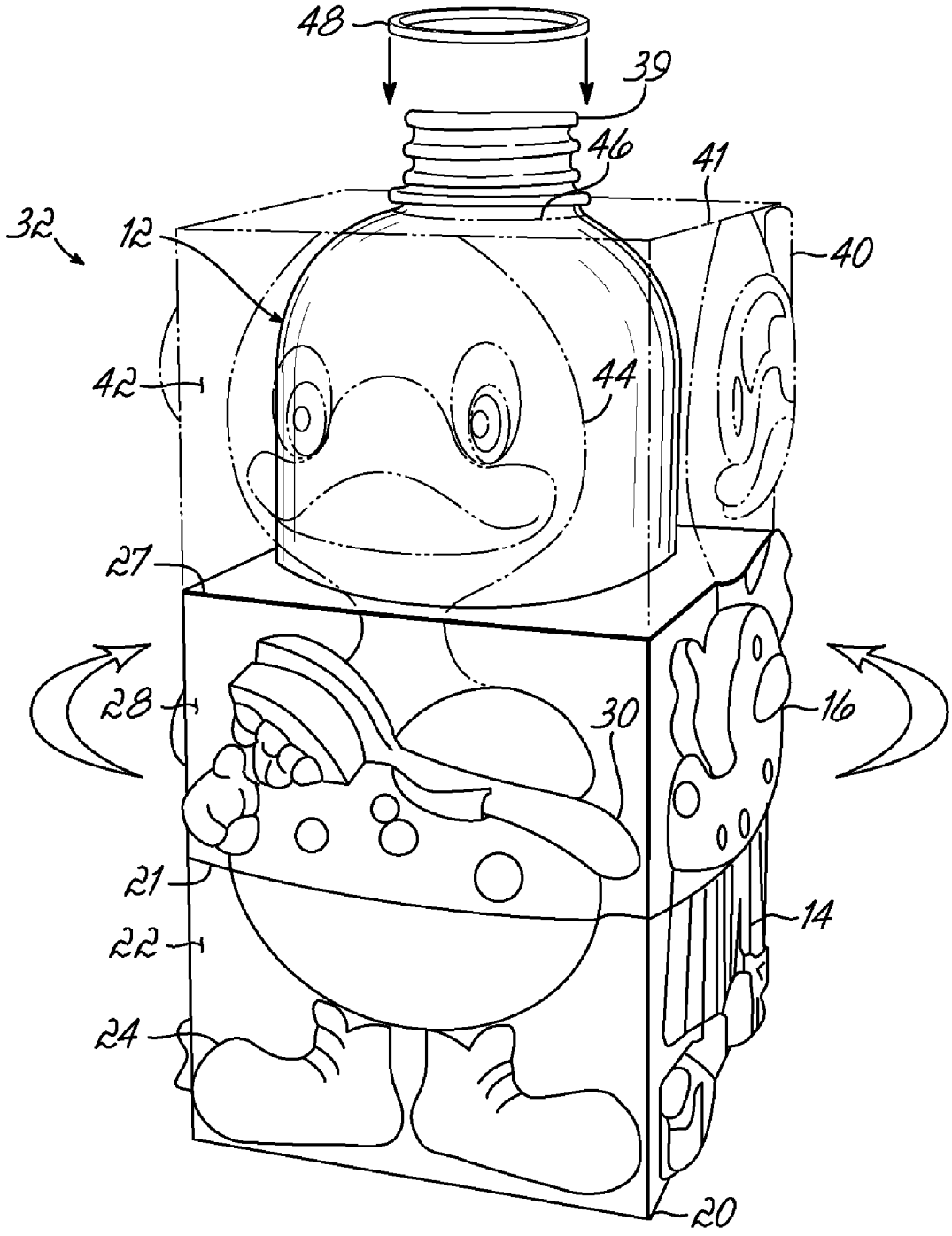
FIG. 3 is a perspective view showing a second rotatable tier drawn in phantom line stacked on the first rotatable tier.

With reference to FIGS. 2 and 3, the rotatable tier 16 is rotatable about the holder 12. A central aperture 26 is formed in the rotatable tier 16 such that the rotatable tier 16 is rotatable around the holder 12, as is shown by the arrows in FIG. 3. Like the fixed tier 14, the rotatable tier 16 also has a geometric shape with a polygon-shaped perimeter 27 and has at least one rotatable side 28. The rotatable side 28 also has at least one design 30 formed thereon. In the exemplary embodiment shown in FIG. 3, the design 30 is an upper torso with arms and hands.

Figure 4:
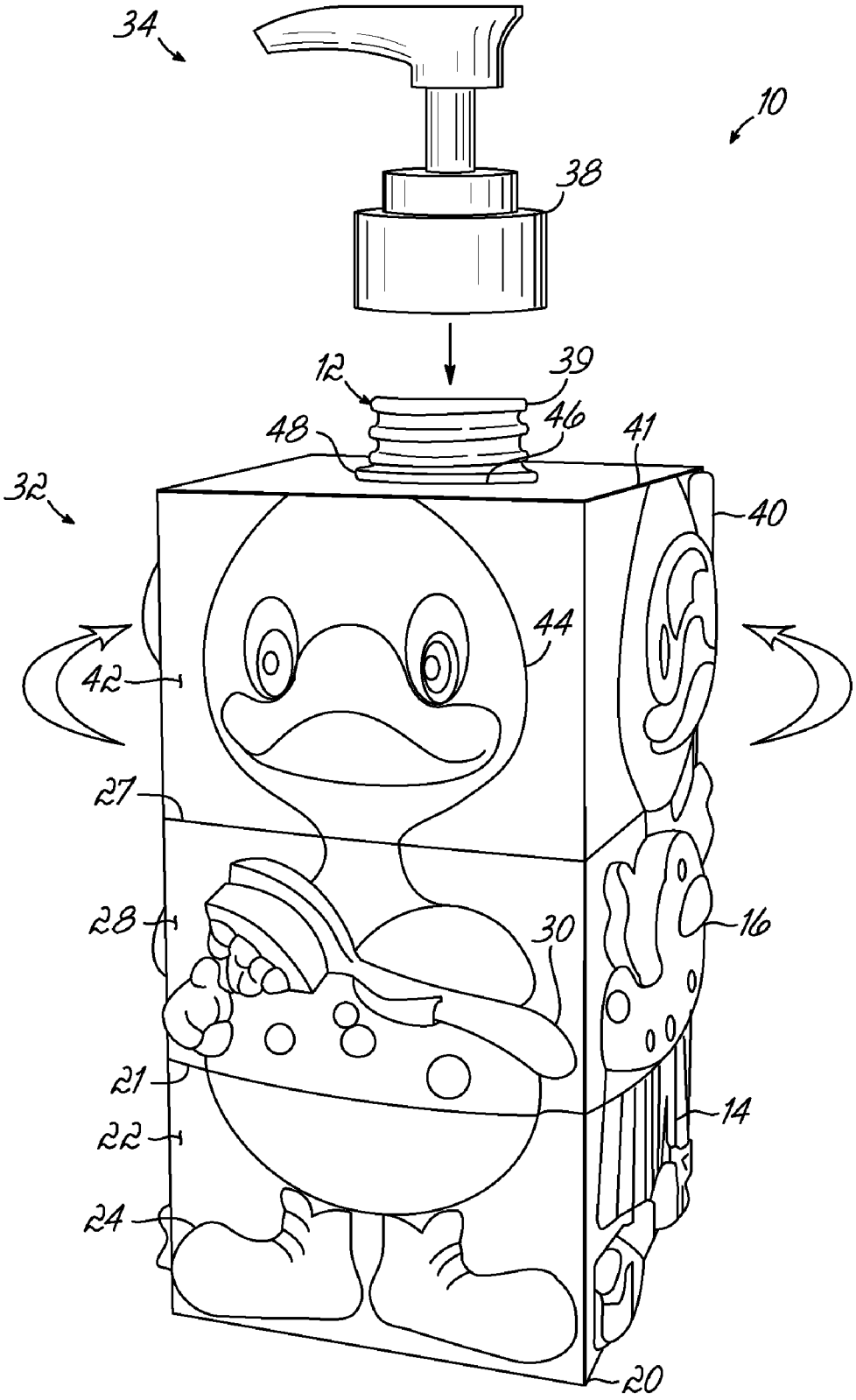
FIG. 4 is a perspective view of the embodiment of FIG. 1 showing removable attachment of a pump.

When the design 30 on the rotatable side 28 is aligned with the design 24 on the fixed side 22, a composite design 32 is formed. In other words, in one embodiment, the designs 24 and 30 cooperate to form the composite design 32. The composite design 32 may be a character, by way of example, as shown in FIGS. 1, 3, and 4, or another cooperative arrangement of shapes, colors, indicia, surfaces or surface textures.

One skilled in the art will observe and appreciate that each design 24, 30 on the fixed side 22 and rotatable side 28 may be in the form of a sculpture, a picture, a painting, a relief pattern, or other visually discernable design, possibly to create characters or themes such as Santa Claus for holidays such as Christmas, or any number of other popular characters or themes, like Halloween, that children or even adults identify with. In particular, the characters or themes that people identify with may engage them such that they are more likely to wash their hands, brush their teeth, or use the other functions related to the variable design bathroom accessory 10. For example, they may be more apt to brush their teeth while engaged in rotating the rotatable tier 16 relative to the fixed tier 14 to modify the composite design 32 or while they wash their hands prior to or following modifying the composite design 32.

In one embodiment, the polygon-shaped perimeter 21 of the fixed tier 14 and the polygon-shaped perimeter 27 of the rotatable tier 16 define regular polygons. For example, the polygon-shaped perimeters 21, 27 may define an equilateral triangle, square (as shown in FIGS. 1-4), pentagon, or other regular polygon. With reference to FIG. 1, which illustrates square perimeters 21, 27, in one embodiment, the number of rotatable sides 28 is the same as the number of fixed sides 22 such that during rotation of the rotatable tier 16, the perimeters 21, 27 coincide at one or more locations (for example, as shown in FIG. 1). It will be appreciated, however, that the perimeters 21, 27 may not coincide during rotation even when the perimeters 21, 27 define regular polygons and the number of sides 22, 28 is the same. This may be the situation, for example, if the rotatable tier 16 and the fixed tier 14 form a pyramidal-shaped variable design bathroom accessory 10. In this embodiment, the perimeters 21, 27 are regular polygons though one perimeter encloses a smaller area than the other.

In one embodiment, as shown in FIG. 1, the holder 12 is a liquid dispenser 34 having a liquid reservoir 36 (shown in FIG. 2). As shown best in FIG. 4, a pump 38 is secured to the holder 12 via threads 39. The liquid reservoir 36 may be used to store liquid soap, lotion, or other liquid, which may be later dispensed by operating the pump 38. While the holder 12 is described as a liquid dispenser 34, the holder 12 may be, for example, a toothbrush holder, a bar soap dish, a tumbler holder, a waste basket, a tissue dispenser, a shower curtain hook or another bathroom accessory.

In the exemplary embodiment of FIG. 1, the variable design bathroom accessory 10 has three tiers. The fixed tier 14 is affixed to the base (not shown) of the liquid reservoir 36. The first rotatable tier 16 is stacked onto the fixed tier 14 and is rotatable around the liquid reservoir 36. A second rotatable tier 40 is stacked on the first rotatable tier 16 and is also rotatable around the liquid reservoir 36. The second rotatable tier 40 has a geometric shape with a polygon-shaped perimeter 41 with a second rotatable side 42. The second rotatable side 42 has at least one design 44 formed thereon.

In the embodiment shown in FIG. 1, the second rotatable tier 40 resides on top of the first rotatable tier 16, though it is not necessary that the tiers contact one another. By way of example, the second rotatable tier 40 may have an aperture 46 formed to cooperate with liquid reservoir 36 and permit a portion of the liquid reservoir 36, such as the threads 39, to protrude through the aperture 46. The pump 38 may then be attached to the threads 39, as shown in FIG. 4. Accordingly, the first and second rotatable tiers 16, 40 are blocked from accidental removal by the pump 38. While the exemplary embodiment illustrates the fixed tier 14 forming the base 20 of the variable design bathroom accessory 10, one skilled will recognize that the fixed tier 14 may be positioned as a middle or an upper tier. However, in the example shown, the fixed tier 14 is advantageously positioned to form the base 20 of the variable design bathroom accessory 10 as it forms the base 20 while preventing the rotatable tiers 16, 40 from falling off of the holder 12.

Additionally, as shown, each of the two rotatable tiers 16, 40 and the fixed tier 14 has a square perimeter such that each tier 14, 16, 40, has four sides. Therefore, four designs per tier are possible. Thus, the designs 24, 30, 44 align to form a composite design 32 when the perimeters 21, 27, 41 coincide.

In one embodiment, the composite design 32 is a character, as shown in FIGS. 3 and 4. For example, the design 44 on the second rotatable tier 40 is formed with the head of the character. In fact, each design 44 on the rotatable side 42 may be a head though each head may have a different set of accessories, facial expressions, or other entertaining variations. The sides 28 on the first rotatable tier 16 may have designs 30 possibly from the shoulders to the waist of the character. By way of example, the designs 30 on the first rotatable tier 16 may include changes in accessory clothing or other entertaining changes in body position. Finally, the fixed tier 14 may have designs 24 on the fixed sides 22 forming the legs and feet of the character. Likewise, the designs 24 may have changes in accessories or foot position, or other entertaining variations.

While the fixed side 22 is shown in FIGS. 1 and 4 as substantially aligning with the rotatable side 28 such that the fixed side 22 and rotatable side 28 are coplanar, the sides 22, 28 may align when they are not coplanar or where none of the perimeters 21, 27, 41 are capable of coinciding. For example, in a three-tier variable design bathroom accessory 10, the second rotatable tier 40 may be smaller than the first rotatable tier 16 that may in turn be smaller than the fixed tier 14 forming a stair-step like structure from bottom to top. In this configuration then, the sides 22, 28, 42 may align visually but they are not coplanar. Other variations of non-coplanar sides are also possible.

While a two and three tier variable design bathroom accessory 10 is described, one skilled in the art will observe that multiple additional tiers may be added forming any one of a number of entertaining variable design bathroom accessories 10. One skilled in the art will observe that as the number of sides 22, 28, 42 increases the number of possible composite design variations increases, and, consequently, entertainment value may also increase.

In another embodiment, a cap 48, as shown in FIGS. 3 and 4, is attached to the liquid reservoir 36. The cap 48, rather than the pump 38, prevents the rotatable tiers 16, 40 from being pulled or from otherwise falling off of the liquid reservoir 36, though the cap 48 does not inhibit rotation of any of the rotatable tiers 16, 40. It will be appreciated that when refilling the liquid reservoir 36 with liquid, the pump 38 must be removed. In this situation, the cap 48 prevents the rotatable tiers 16, 40 from falling off of the liquid reservoir 36.

In addition, the variable design bathroom accessory 10 may be made of any material satisfactory for bathroom environments that may be easily cleaned, does not degrade with water contact, or react in any manner with soaps or other liquids that may be in or around the variable design bathroom accessory 10. These materials may include any one of a number of plastics, wood, metal, glass, ceramic, such as bone china or porcelain, resin, or papier-mâché that provides more detail for the designs 24, 30, 44 formed on the fixed side 22 and rotatable sides 28, 42.

These and other advantages, embodiments and modifications will be readily apparent from the foregoing to those of ordinary skill in the art without departing from the scope of the invention and applicant intends to be bound only by the claims appended hereto.

What is claimed is:

1. A variable design bathroom accessory comprising:

a holder having a central axis; wherein the holder is a liquid dispenser comprising a liquid reservoir for storing a liquid and a pump for dispensing the liquid from the liquid reservoir a fixed tier fixedly attached to the holder and having a fixed side with a first design thereon; and a first rotatable tier rotatable about the holder and in proximity to the fixed tier, the first rotatable tier having a first rotatable side with a second design thereon and rotatable around the central axis, whereby rotation of the first rotatable tier aligns the first rotatable side with the fixed side such that the first design and the second design cooperate to form a composite design.

2. The variable design bathroom accessory of claim 1 wherein the fixed tier has a first polygon-shaped perimeter and the first rotatable tier has a second polygon-shaped perimeter.

3. The variable design bathroom accessory of claim 2 wherein the first and the second polygon-shaped perimeters define regular polygons.

4. The variable design bathroom accessory of claim 3 wherein the second regular-polygon shaped perimeter coincides with the first regular-polygon shaped perimeter during rotation of the first rotatable tier.

5. The variable design bathroom accessory of claim 2 wherein the fixed tier has a plurality of fixed sides and the first rotatable tier has a plurality of first rotatable sides, each of the fixed sides of the fixed tier and each of the first rotatable sides of the first rotatable tier have a unique design formed thereon, whereby rotation of the first rotatable tier aligns at least one fixed side with at least one first rotatable side such that at least one design on the fixed tier and at least one design on the rotatable tier form the composite design.

6. The variable design bathroom accessory of claim 2 wherein each of the first polygon-shaped perimeter and the second polygon-shaped perimeter define a square, whereby rotation of the first rotatable tier causes the first square perimeter and the second square perimeter to coincide.

7. The variable design bathroom accessory of claim 1 wherein the first rotatable tier is rotatable while in contact with the fixed tier.

8. The variable design bathroom accessory of claim 1 further comprising:

a second rotatable tier rotatable about the holder and in proximity to the first rotatable tier, the second rotatable tier having a second rotatable side with a third design thereon and being rotatable around the central axis whereby rotation of the second rotatable tier aligns the second rotatable side with the first rotatable side such that the second and the third designs form at least a portion of the composite design.

9. A liquid dispenser including a pump for dispensing a liquid and a liquid reservoir for storing the liquid, the liquid reservoir having a central axis, the liquid dispenser comprising:

a fixed tier fixedly attached to the liquid reservoir and having a fixed side with a first design thereon; and a first rotatable tier rotatable about the liquid reservoir and in proximity to the fixed tier, the first rotatable tier having a first rotatable side with a second design thereon and being rotatable around the central axis, whereby rotation of the first rotatable tier aligns the first rotatable side and the fixed side such that the first design and the second design cooperate to form a composite design.

10. The liquid dispenser of claim 9 wherein the fixed tier has a first polygon-shaped perimeter and the first rotatable tier has a second polygon-shaped perimeter.

11. The liquid dispenser of claim 10 wherein the first and the second polygon-shaped perimeter define regular polygons.

12. The liquid dispenser of claim 11 wherein the second regular-polygon shaped perimeter coincides with the first regular-polygon shaped perimeter during rotation of the first rotatable tier.

13. The liquid dispenser of claim 10 wherein the fixed tier has a plurality of fixed sides and the first rotatable tier has a plurality of first rotatable sides, each of the fixed sides and each of the first rotatable sides of the first rotatable tier have a unique design formed thereon, whereby rotation of the first rotatable tier aligns at least one first rotatable side with at least one fixed side such that at least one design on the fixed tier and at least one design on the first rotatable tier form the composite design.

14. The liquid dispenser of claim 10 wherein each of the first polygon-shaped perimeter and the second polygon-shaped perimeter define a square, whereby rotation of the first rotatable tier causes the first square perimeter and the second square perimeter to coincide.

15. The liquid dispenser of claim 9 further comprising:

a second rotatable tier rotatable about the liquid reservoir and in proximity to the first rotatable tier, the second rotatable tier having a second rotatable side with a second design thereon and being rotatable around the central axis, whereby rotation of the second rotatable tier aligns the second rotatable side with the first rotatable side such that the second and the third designs form at least a portion of the composite design.

16. The liquid dispenser of claim 15 wherein the fixed tier has a first regular polygon-shaped perimeter, the first rotatable tier has a second regular polygon-shaped perimeter, and the second rotatable tier has a third regular polygon-shaped perimeter, whereby rotation of the first rotatable tier causes second regular polygon-shaped perimeter and the first regular polygon-shaped perimeter to coincide, and rotation of the second rotatable tier causes the third polygon-shaped perimeter and the second polygon-shaped perimeter to coincide.

17. The liquid dispenser of claim 16 wherein the fixed tier has a plurality of fixed sides and the first rotatable tier has a plurality of rotatable sides, each of the fixed sides, each of the first rotatable sides, and each of the second rotatable sides have a design formed thereon, whereby rotation of the first rotatable tier aligns the first rotatable sides with the fixed tier sides and rotation of the second rotatable tier aligns the second rotatable sides with the first rotatable sides such that at least one design on the fixed tier, at least one design on the first rotatable tier, and at least one design on the second rotatable tier form the composite design.

18. The liquid dispenser of claim 9 wherein the pump captures the first rotatable tier in rotatable relation with the fixed tier.

19. A liquid dispenser including a pump for dispensing a liquid and a liquid reservoir for storing the liquid, the liquid reservoir having a central axis, the liquid dispenser comprising:

a fixed tier fixedly attached to the liquid reservoir and having a square perimeter and four fixed sides each with a design thereon;

a first rotatable tier rotatable about the liquid reservoir and in proximity to the fixed tier, the first rotatable tier having a square perimeter, four first rotatable sides each with a design thereon, and being rotatable around the central axis; and a second rotatable tier rotatable about the liquid reservoir and in proximity to the first rotatable tier, the second rotatable tier having the square perimeter, four second rotatable sides each with a design thereon, and rotatable around the central axis, whereby rotation of the first rotatable tier aligns one first rotatable side with one fixed side, and rotation of the second rotatable tier aligns one second rotatable side with the one first rotatable side such that one design on the fixed tier, one design on the first rotatable tier, and one design on the second rotatable tier cooperate to form one composite design.

* * * * *

UNITED STATES PATENT AND TRADEMARK OFFICE

CERTIFICATE OF CORRECTION

PATENT NO. : 7,806,296 B2
APPLICATION NO. : 12/169221
DATED : October 5, 2010
INVENTOR(S) : James Connors It is certified that error appears in the above-identified patent and that said Letters Patent is hereby corrected as shown below:

Claim 1
Column 5, line 22, "a central axis; wherein" should read --a central axis wherein--.

Claim 1
Column 5, line 25, "liquid reservoir" should read --liquid reservoir;--.

Signed and Sealed this
Eighth Day of February, 2011

David J. Kappos

David J. Kappos
*Director of the United States Patent and Trademark Office*